US005866837A

United States Patent [19]

Biven et al.

[11] Patent Number: 5,866,837

[45] Date of Patent: Feb. 2, 1999

[54] METHOD FOR SAFE FLIGHT TESTING OF HIGH VELOCITY INTERCEPTOR MISSILES

[75] Inventors: Earl U. Biven, Irvine; Gary C. Mikelson, Garden Grove; Gary A. Scapellati, Huntington Beach, all of Calif.

[73] Assignee: McDonnell Douglas Corporation, St. Louis, Mo.

[21] Appl. No.: 878,124

[22] Filed: Jun. 18, 1997

[51] Int. Cl.[6] ..... B64D 1/04; F41G 7/00

[52] U.S. Cl. ..... 89/1.11; 244/3.11

[58] Field of Search ..... 89/1.11; 244/3.11, 244/3.15, 3.16; 73/167

[56] References Cited

U.S. PATENT DOCUMENTS

| | | | |
|---|---|---|---|
| 4,300,736 | 11/1981 | Miles | 244/3.13 |
| 4,470,562 | 9/1984 | Hall et al. | 244/3.2 |
| 4,726,224 | 2/1988 | D'Ausilio | 73/167 |
| 5,153,366 | 10/1992 | Lucas | 89/1.11 |
| 5,340,056 | 8/1994 | Guelman et al. | 244/3.16 |
| 5,464,174 | 11/1995 | Laures | 89/1.11 |
| 5,710,423 | 1/1998 | Biven et al. | 244/3.11 |

OTHER PUBLICATIONS

"Staying Prepared Against Ballistic Missiles", Defense Issues, vol. 11, No. 18, Mar. 1996.

"National Missile Defense Program: When, not Whether", Defense Issues, vol. 11, No. 48, May 1996.

*Primary Examiner*—Charles Jordan

*Assistant Examiner*—Theresa M. Wesson

*Attorney, Agent, or Firm*—Westerlund & Powell; Raymond H.J. Powell, Jr.; Robert A. Westerlund

[57] ABSTRACT

An intercept missile testing method which includes the steps of launching a test missile threat from a first location on a substantially vertical trajectory, e.g., with a flight path angle greater than about 70°, towards an intercept point, and launching a test intercept missile from a second location on a substantially vertical trajectory, e.g., with a flight path angle greater than about 70°, towards the intercept point. The flight paths are selected so that the test intercept missile will intercept the test missile threat exoatmospherically, at an intercept (engagement crossing) angle of less than about 30°. Preferably, the launch velocities and trajectories of the test intercept missile and the test missile threat are selected so that the intercept will occur exoatmospherically when the test missile threat is on a downward trajectory at a velocity of 5–8 km/sec, while the test intercept missile is on an upward trajectory at a velocity 5–9 km/sec. The first location is preferably Wake Island, Johnston Island, or Kauai, and the second location is preferably Meck Island.

19 Claims, 4 Drawing Sheets

| TRAJECTORY | LAUNCH | IMPACT |
|---|---|---|
| THREAT NK | NORTH KOREA | SEATTLE |
| THREAT R | RUSSIA | ST. LOUIS |
| THREAT L | LIBYA | WASHINGTON, D.C. |

| TRAJECTORY | LAUNCH | IMPACT |
|---|---|---|
| THREAT NK | NORTH KOREA | SEATTLE |
| THREAT R | RUSSIA | ST. LOUIS |
| THREAT L | LIBYA | WASHINGTON, D.C. |

| TRAJECTORY | LAUNCH | IMPACT |
| --- | --- | --- |
| THREAT C | CHINA | LOS ANGELES |

| TRAJECTORY | LAUNCH | IMPACT |
|---|---|---|
| TEST THREAT | KAUAI ISLAND | NE OF KWAJALEIN ATOLL |
| TEST GBI | MECK ISLAND | 1800 km S OF SHEMYA |

METHOD FOR SAFE FLIGHT TESTING OF HIGH VELOCITY INTERCEPTOR MISSILES

BACKGROUND OF THE INVENTION

The present invention relates generally to flight testing of high velocity interceptor missiles used in ground-based missile defense systems, and more particularly, to a novel method for realistic, real-time testing of high velocity interceptor missiles in a safe and accurate manner.

An important part of the U.S. National Missile Defense (NMD) is engagement of Intercontinental Ballistic Missile (ICBM) threats by the Ground Based Interceptor (GBI). FIG. 1 illustrates three ICBM threats to the U.S., and FIG. 2 more specifically depicts the first and second (if needed) intercepts of a Chinese ICBM aimed at Los Angeles. In accordance with the terms of the 1972 Anti-Ballistic Missile (ABM) Treaty with the Soviet Union, GBI missiles will be restricted to a single ABM base at Grand Forks, N.D. Due to this restriction regarding the launch site of the missiles, the first intercept of any ICBM warhead, termed the "reentry vehicle (RV)", will occur at long distances from Grand Forks, and the relative velocity of the RV with respect to the GBI missile will be very high, i.e., about 10–14 km/sec. Second and third intercepts (if required to defeat an RV threat) could also have high relative closing velocities, e.g., about 8–11 km/sec.

A high relative closing velocity translates into a short time between acquisition of the RV by the on-board sensor of the GBI missile and the time of intercept. Since many GBI kill vehicle (KV) endgame functions must be performed in that short time, realistic real-time testing to validate the high velocity GBI in the endgame will become a formidable task when NMD and GBI full-up testing takes place in 1999 or shortly thereafter. These KV endgame functions include cluster acquisition, divert-to-cluster centroid, object resolution, track association, sensor-to-sensor object correlation, features and discriminants collection, object classification, RV designation, divert-to-RV centroid, aimpoint computation, smart aimpoint homing, and hit-to-kill.

Range safety is the biggest problem with respect to validation testing of the GBI high velocity KV endgame functions. There must be an extremely low probability that the GBI KV, the target (i.e. ICBM threat), or any intercept debris will impact on a land mass or continue into orbit around the earth. Since the United States must adhere to the 1972 ABM Treaty, ABM testing will be restricted to the treaty-designated test ranges, namely, Kwajalein and White Sands. The White Sands Test Range is totally unacceptable for many reasons. For example, the target velocity would be too high, the interceptor velocity would be too high, and the intercept regime would be outside the atmosphere, all of which would result in undesirable range safety consequences. The Kwajalein Test Range has been used for testing of ICBMs and for testing of medium relative velocity intercepts within the atmoshphere.

However, exoatmoshperic interception of a test threat complex launched from Vandenberg by a high velocity GBI KV launched from Kwajalein would create GBI KV and/or intercept debris that could go into orbit or impact on populated areas many thousands of miles away. The debris impact area would be extensive, spanning continents. Orbiting debris from the intercept would create significant hazards for functioning satellites in lower orbits, and life-threatening dangers for manned spacecraft and space stations. Thus, the overall result would be unacceptable range safety.

Based on the above and foregoing, there presently exists a need in the art for a safe and effective method for realistic, real-time testing of high velocity GBI missiles (KVs). The present invention fulfills this need in the art.

SUMMARY OF THE INVENTION

The present invention encompasses an intercept missile testing method which includes the steps of launching a test missile threat from a first location on a substantially lofted or vertical trajectory, e.g., with a flight path angle greater than about 70°, towards an intercept point, and launching a test intercept missile from a second location on a substantially lofted or vertical trajectory, e.g., with a flight path angle greater than about 70°, towards the intercept point. The flight paths are selected so that the test intercept missile will intercept the test missile threat exoatmospherically, at an intercept (engagement crossing) angle of less than about 30°.

Preferably, the launch velocities and trajectories of the test intercept missile and the test missile threat are selected so that the intercept will occur exoatmospherically when the test missile threat is on a downward trajectory at a velocity of 5–8 km/sec, while the test intercept missile is on an upward trajectory at a velocity 5–9 km/sec. The first location is preferably Wake Island, Johnston Island, or Kauai, and the second location is preferably Meck Island.

BRIEF DESCRIPTION OF THE DRAWINGS

The above and other objects, features, and advantages of the present invention will become apparent from the following detailed description taken in conjunction with the accompanying drawings, in which.

DETAILED DESCRIPTION OF THE INVENTION

In overview, the present invention encompasses an intercept missile testing method which overcomes the range safety problems inherent with conventional intercept missile testing procedures by ensuring a predominantly "vertical" engagement between the intercept missile and the target, as opposed to the predominantly "horizontal" engagement which would result from using the conventional intercept missile testing procedures. In addition to eliminating (or greatly minimizing) the range safety problem, the method of the present invention allows real-time, realistic testing of the GBI KV endgame functions in the most compressed timeline, which corresponds to the highest relative endgame velocities.

Figure 1:
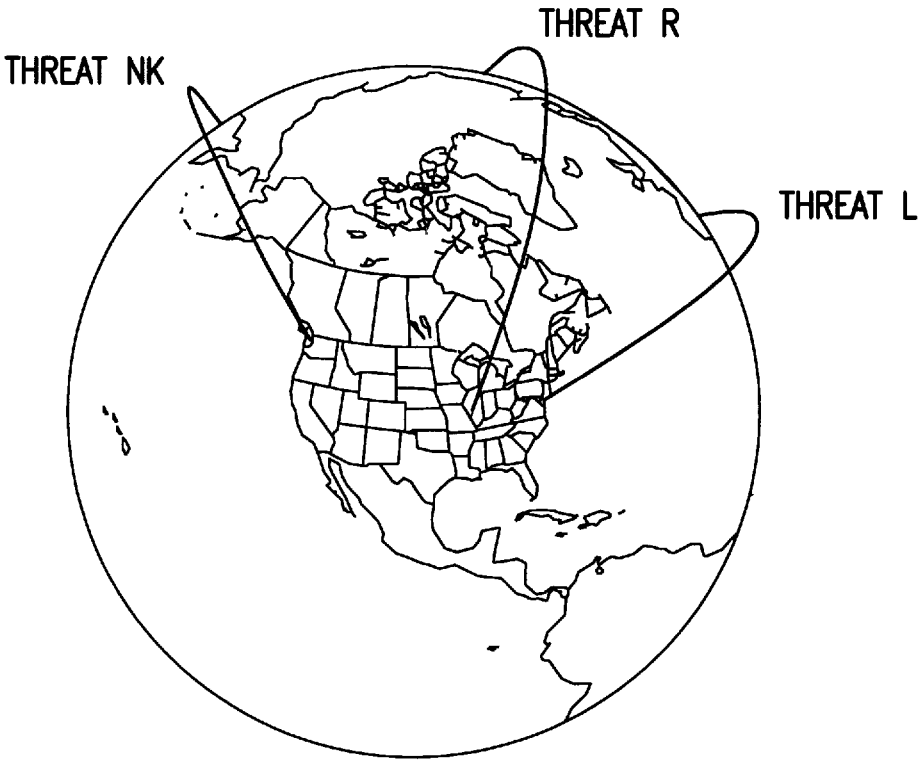
FIG. 1 is a map diagram illustrating three examples of ICBM threat trajectories.
Figure 2:
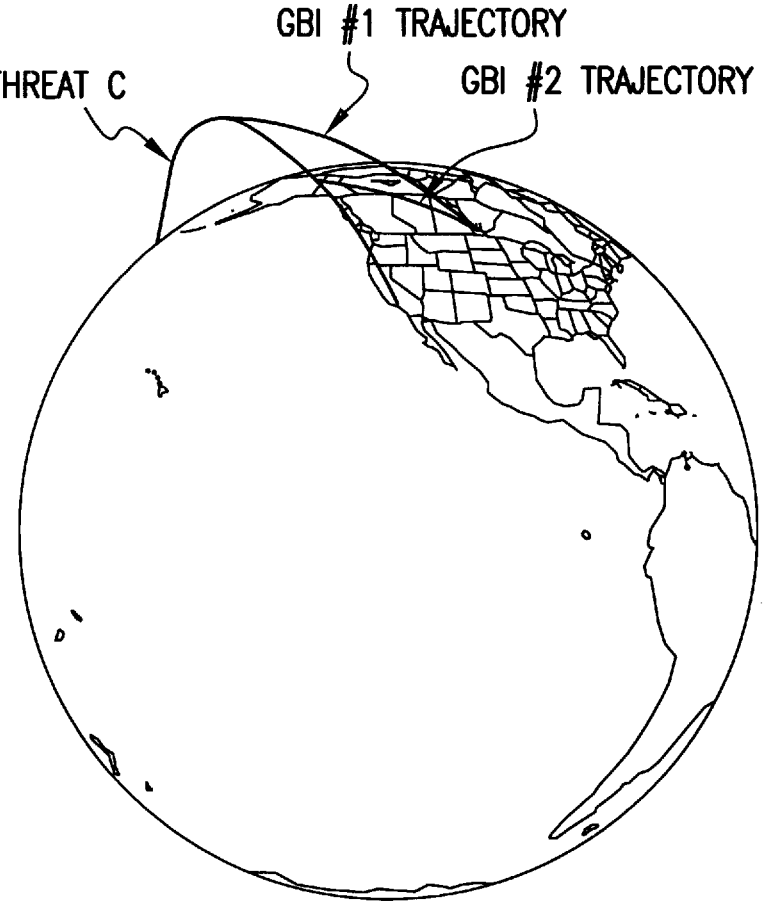
FIG. 2 is a map diagram illustrating exemplary GBI KV trajectories to first and second intercepts of a Chinese ICBM aimed at Los Angeles.
Figure 3:
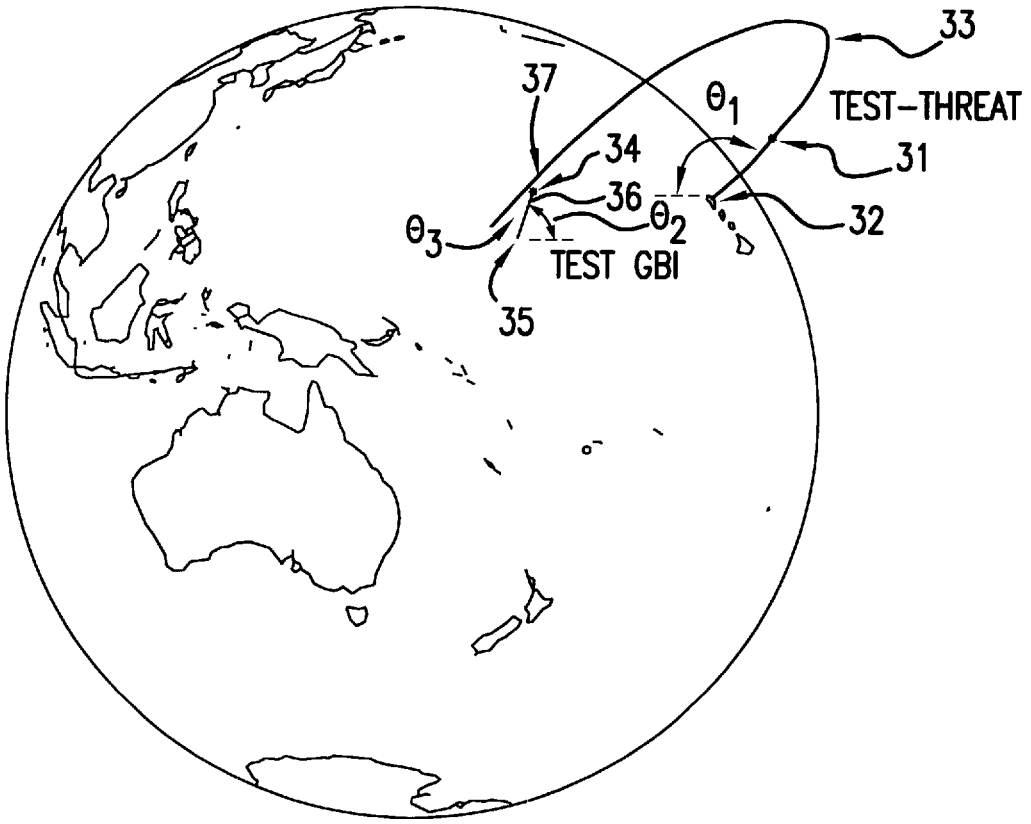
FIG. 3 is a map diagram illustrating the intercept missile testing method of the present invention for an exemplary case; and, FIG. 4 is a map diagram illustrating range safety keep-out circles near Kwajalein Atoll.

More particularly, as shown in FIG. 3, in accordance with the intercept missile testing method of the present invention, a test threat missile 31 (e.g., an ICBM or other strategic ballistic missile, i.e., test missile threat) would be launched from Wake Island, Johnston Island, or Kauai (in the Hawaiian Islands) as a first launch location 32, on a nearly vertical trajectory 33, and the GBI KV 34 would be launched from Meck Island (in the Kwajalein Test Range) as a second launch location 35, also on a nearly vertical trajectory 36. In this connection, both missiles would be launched with flight path (trajectory) angles $D_1$ and $D_2$ greater than 70° to ensure that nothing can go into orbit. Intercept would occur exoatmospherically when the target is on the way down at 5–8 km/sec. while the GBI KV is on the way up at 5–9 km/sec. The intercept angle $D_3$ (i.e., engagement crossing angle) would be less than 30°, as in nearly all first intercepts of ICBMs by tactical GBI KVs launched from Grand Forks AFB. The term "exoatmospheric" as used herein means outside of the "sensible" atmosphere, i.e., altitudes between 100 km and 2000 km.

FIG. 3 illustrates the above-described intercept missile testing method of the present invention for the case in which the test missile threat or reentry vehicle (RV) is launched from Kauai and impacts 250 km. northwest of Kwajalein Island, and the test GBI KV is launched from Meck Island and intercepts the RV at indicated location 37 at an altitude of 1246 km. In the case of a miss, the test GBI KV would impact 1800 km. south of Shemya Island near the tip of the Aleutian Islands chain. In this example, the relative velocity is 12,036 m/sec and the intercept angle is 6.23°.

Figure 4:
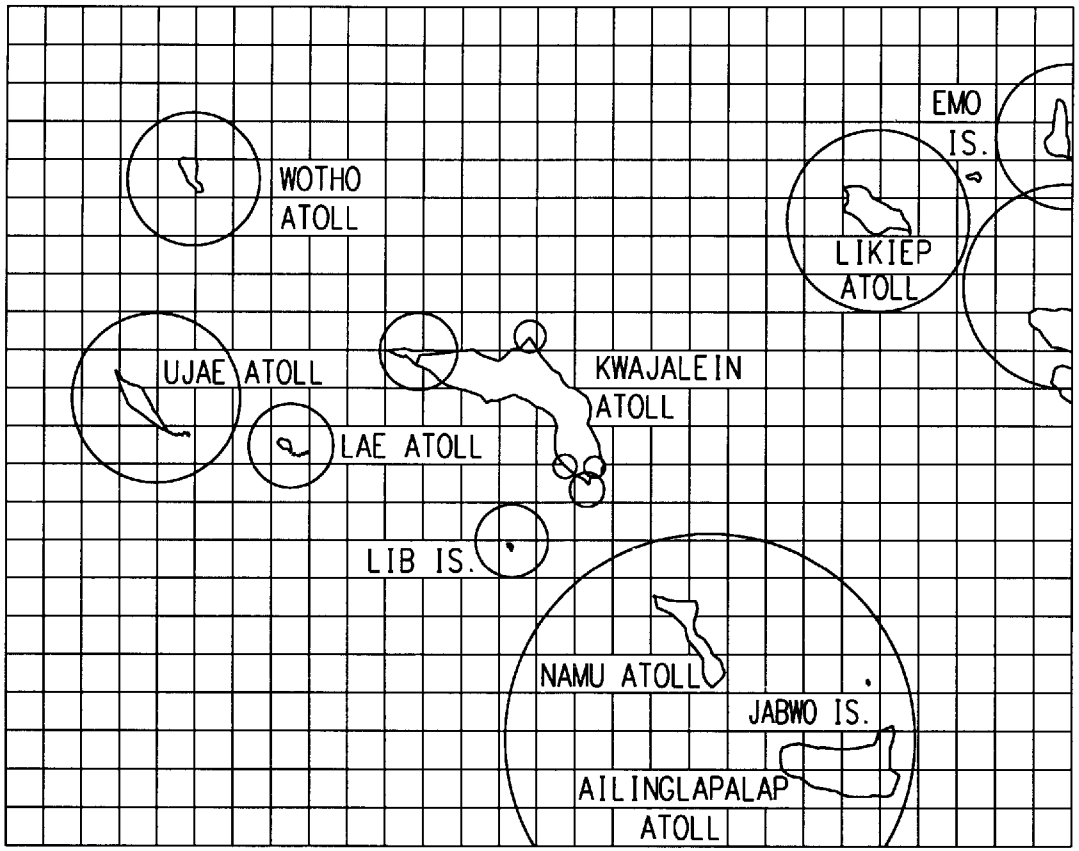

It will be appreciated that the RV and GBI KV trajectories must be planned so that spent stages and normal deployment hardware debris from the test GBI KV and test RV boosters will impact in unpopulated ocean areas. Areas in the vicinity of the Kwajalein Atoll that must be avoided are illustrated in FIG. 4 by keep-out circles drawn around populated areas and valuable range assets. Intercept debris impacts are less predictable but can also be contained with careful planning. The test GBI KV-test RV intercept will result in two debris clouds, each following the projected trajectory of its corresponding colliding body. The RV (downwardly-moving) cloud will be confined to a small area because of the short time between the time of intercept and the time of impact at sea level. The GBI KV (upwardly-moving) cloud, however, will travel a much longer time, thereby allowing the debris to spread out and thereby creating a much larger debris impact area.

Although the probability of debris impact on populated areas cannot be totally eliminated, proper planning can increase the probability of the debris impacting in unpopulated ocean areas (such as south of the Aleutian Islands) to 99.999%, while ensuring that no debris would go into orbit. In short, even though the GBI KV debris cloud will spread out more, it will almost certainly fall into empty ocean because the GBI KV would be on a highly elliptical trajectory with no possibility of impacting on any large land mass or of continuing into orbit. As previously mentioned, in the case of a miss, the whole GBI KV will travel along its highly elliptical trajectory but still impact in empty ocean. Additionally, no object from the test will continue into orbit to forever endanger functioning satellites or manned space stations, although appropriate launch windows must be selected to avoid low-orbiting satellites during the test.

The conventional approach would be to launch the test RV from Vandenberg AFB towards a point in the ocean north of Kwajalein, and to launch the test GBI KV from Meck Island, with the trajectories of the test RV and the test GBI KV being set so as to result in an exoatmospheric intercept in which the engagement would be predominantly "horizontal" with the on-board sensor of the test GBI KV viewing the test RV above the earth limb. At full velocity, the test GBI KV would still be "climbing" at the time of intercept, so that the intercept debris associated with the test GBI KV or the test GBI KV itself (in the event of a miss) could go into orbit or land in a populated area (e.g., in Canada or Europe), thereby resulting in unacceptable range safety. An alternative would be to conduct the test at reduced test GBI KV velocity to render the engagement safer, but this would eliminate the compressed timeline which is required to enable real-time, realistic testing of KV endgame functions.

Although the present invention has been described in detail hereinabove, it should be clearly understood that many other alternative embodiments, variations and/or modifications of the basic inventive concepts taught herein which may appear to those skilled in the pertinent art will still fall within the spirit and scope of the present invention as defined in the appended claims.

What is claimed is:

1. An intercept missile testing method, comprising the steps of:

launching a test threat missile from a first location towards an exoatmospheric intercept point; and, launching a test intercept missile from a second location on a substantially vertical trajectory towards the exoatmospheric intercept point, and wherein the respective trajectories and launch velocities of the test threat missile and test intercept missile are selected such that the test threat missile and the test intercept missile intercept at the intercept point at an engagement crossing angle of less that approximately 30°.

2. The intercept missile testing method as set forth in claim 1, wherein the test threat missile is launched on substantially vertical trajectory.

3. The intercept missile testing method as set forth in claim 2, wherein the substantially vertical trajectory of the test threat missile provides a flight path angle greater than approximately 70°.

4. The intercept missile testing method as set forth in claim 3, wherein the substantially vertical trajectory of the test intercept missile provides a flight path angle greater than approximately 70°.

5. The intercept missile testing method as set forth in claim 4, wherein the first location comprises a location from a group consisting of Wake Island, Johnston Island, or Kauai.

6. The intercept missile testing method as set forth in claim 5, wherein the second location comprises Meck Island.

7. The intercept missile testing method as set forth in claim 6, wherein the exoatmospheric intercept point is above 100 km altitude.

8. The intercept missile testing method as set forth in claim 4, wherein the test threat missile comprises a strategic ballistic missile.

9. The intercept missile testing method as set forth in claim 8, wherein the exoatmospheric intercept point is above 100 km altitude.

10. The intercept missile testing method as set forth in claim 4, wherein the respective trajectories and launch velocities of the test threat missile and test intercept missile are selected such that the test threat missile and the test intercept missile intercept at the intercept point when the test threat missile is on a downward trajectory at a velocity of 5–8 km/sec, while the test intercept missile is on an upward trajectory at a velocity of 5–9 km/sec.

11. The intercept missile testing method as set forth in claim 1, wherein the first location comprises a location selected from the group consisting of Wake Island, Johnston Island, and Kauai.

12. The intercept missile testing method as set forth in claim 11, wherein the second location comprises Meck Island.

13. The intercept missile testing method as set forth in claim 1, wherein the test threat missile comprises a strategic ballistic missile.

14. The intercept missile testing method as set forth in claim 1, wherein the exoatmospheric intercept point is above 100 km altitude.

15. An intercept missile testing method, comprising the steps of:

launching a test threat missile from a first location towards an exoatmospheric intercept point with a flight path angle of greater that 70°;

launching a test intercept missile from a second location on a substantially vertical trajectory towards the exoatmospheric intercept point with a flight path angle of greater than 70°;

wherein the respective trajectories and launch velocities of the test threat missile and test intercept missile are selected such that the test threat missile and the test intercept missile intercept at the intercept point when the test threat missile is on a downward trajectory at a velocity of 5–8 km/sec, while the test intercept missile is on an upward trajectory at a velocity of 5–9 km/sec; and, wherein the respective trajectories and launch velocities of the test threat missile and test intercept missile are selected such that the test threat missile and the test intercept missile intercept at the intercept point at an engagement crossing angle of less than approximately 30°.

16. The intercept missile testing method as set forth in claim 15, wherein:

the first location comprises a location selected from the group consisting of Wake Island, Johnston Island, and Kauai; and the second location comprises Meck Island.

17. The intercept missile testing method as set forth in claim 16, wherein:

the test threat missile comprises an Intercontinental Ballistic Missile; and the test intercept missile comprises a Ground Based Interceptor Kill Vehicle.

18. The intercept missile testing method as set forth in claim 15, wherein:

the test threat missile comprises an Intercontinental Ballistic Missile; and, the test intercept missile comprises a Ground Based Interceptor Kill Vehicle.

19. An intercept missile testing method, comprising the steps of:

launching a test threat missile from a first location towards an exoatmospheric intercept point, wherein the first location comprises a location selected from the group consisting of Wake Island, Johnston Island, and Kauai; and launching a test intercept missile from a second location on a substantially vertical trajectory towards the exoatmospheric intercept point, wherein the second location comprises Meck Island, and wherein the respective trajectories and launch velocities of the test threat missile and test intercept missile are selected such that the test threat missile and the test intercept missile intercept at the intercept point at an engagement crossing angle of less than approximately 30 °.

* * * * *